United States Patent [19]

Yamada et al.

[11] 4,038,749

[45] Aug. 2, 1977

[54] ELECTRIC DRY SHAVER

[75] Inventors: Norio Yamada; Masao Matsumoto; Tsutomu Adachi, all of Hikone; Hirozo Imai, Hirakata; Masao Kubo, Hikone, all of Japan

[73] Assignee: Matsushita Electric Works Ltd., Osaka, Japan

[21] Appl. No.: 651,636

[22] Filed: Jan. 23, 1976

[30] Foreign Application Priority Data

Jan. 27, 1975 Japan ..... 50-11793

[51] Int. Cl.[2] ..... B26B 14/02

[52] U.S. Cl. ..... 30/43.92

[58] Field of Search ..... 30/346.51, 43.91, 43.92, 30/43.5, 43.6, 43.8, 43.9

[56] References Cited

U.S. PATENT DOCUMENTS

| | | | |
|---|---|---|---|
| 3,319,334 | 5/1967 | Bond | 30/43.92 |
| 3,389,467 | 6/1968 | Baumann | 30/43.92 |
| 3,715,803 | 2/1973 | Tyler | 30/43.5 |
| 3,911,573 | 10/1975 | Limberg | 30/43.92 |

FOREIGN PATENT DOCUMENTS

| | | | |
|---|---|---|---|
| 821,010 | 11/1951 | Germany | 30/346.51 |

*Primary Examiner*—Gary L. Smith

*Attorney, Agent, or Firm*—Leydig, Voit, Osann, Mayer & Holt, Ltd.

[57] ABSTRACT

An electric dry shaver with an inner blade block including a parallel array of semiconductor shearing blades and reciprocally driven along inner surface of a flexible thin outer blade mounted substantially in a semicylindrical shape of an outer blade block by means of a vibrating device through a reciprocal driving shaft detachably and resiliently connected to a connecting means pivotably provided in the inner blade block substantially at the center of gravity thereof. The connecting means is pivoted to the inner blade block at an axis passing substantially the center of gravity and intersecting at right angles longitudinal axis of the semicylindrical outer blade in a plane perpendicular to a plane including reciprocal directions of the driving shaft and the connection of the driving shaft to the connecting means is performed at a position adjacent the pivoting axis of the latter.

7 Claims, 9 Drawing Figures

ELECTRIC DRY SHAVER

This invention relates to electric dry shavers and, more particularly, to an improvement in electric dry shavers having an inner blade block to be urged by a spring against the inside surface of a flexible outer shearing foil and such inner blade block is connected through a disengageable coupling means with a driving shaft of a vibrating lever so as to be reciprocally driven by the lever.

In the electric dry shavers of this kind wherein the inner blade block is reciprocated while being urged into contact with the inside surface of the flexible shearing foil, there have been suggested certain types of structure in which the inner blade block will follow the reciprocal driving while keeping as much as possible an intimate contact with the insidesurface of the shearing foil even if the shearing foil is partly pressed to deform during the shaving.

FIG. 1 is for the purpose of explaining coupling relation between the inner blade block A and driving shaft B and, in order to render the following explanations readily understandable, certain terminological definitions therein shall be first made here. The vertical axial direction *a* of the driving shaft B shall be referred to as vertical axis, the lengthwise direction *b* of the inner blade block A shall be referred to as longitudinal axis and the direction *c* intersecting at right angles horizontally the longitudinal axis *b* and also the vertical axis *a* shall be referred to as crosswise axis.

For example, in U.S. Pat. No. 2,908,970, there is shown a structure wherein an inner blade block is disposed to be movable in vertical directions against a resilient force of a push-up spring and the inner blade block is coupled to the vibrating lever so as to be rotatable about the respective vertical axis *a*, longitudinal axis *b* and crosswise axis *c* of the inner blade block. However, in such structure, there have been defects that (i) as the inner blade block is rotatable about the longitudinal axis *b*, the intimate contact of the inner blade block with the shearing foil will be obstructed due to a pressure applied crosswise by downward side sections or skirts of the shearing foil during the shaving operation so that a gap will be produced between the shearing foil and the inner blade block as a result therefrom and no favorable shaving effect will be obtained; (ii) as the inner blade block is rotatable about its vertical axis *a*, the inner blade block will rotate during the operation due to a pressure applied to one end part in the lengthwise direction of the inner blade block, the shearing foil will be likely to be partly bent and deformed or even damaged after repetition of such bending and, in case the user intends to fit the foil holding frame including the shearing foil to the shaver body when the inner blade block is in its rotated position with its axis *b* to be angled with respect to its normal reciprocating directions, the shearing foil will be hit to be damaged by blade tips of the inner blade block, or reversely the tips of the inner blade block will be damaged by the foil holding frame or, possibly, even the user's finger will be hurt by the tips of the inner blade block.

In U.S. Pat. No. 3,319,334, on the other hand, there is shown a structure wherein the inner blade block is movable vertically against the force of a push-up spring and also rotatable about the vertical axis *a* and crosswise axis *c*, while the same is coupled to the vibrating lever so as not to be rotatable about the longitudinal axis *b*. In such structure, however, as the inner blade block is rotatable about its vertical axis *a*, there is involved also the above described defect (ii) in the case of U.S. Pat. No. 2,908,970.

In German Pat. No. 2,102,968 as another example, there is shown a structure wherein the inner blade block is coupled to a vibrating lever so as to be slidable vertically and rotatable about the longitudinal axis *b* and crosswise axis *c* but not to be rotatable about the vertical axis *a*. In such structure, however, as the inner blade block is rotatable about the longitudinal axis *b*, there is still involved the above defect (i) of U.S. Pat. No. 2,908,970.

Therefore, in order to improve the respective defects of the above described three examples, there has been suggested German Patent No. 821,010. A solution of this German Pat. shall be explained with reference to FIGS. 2 and 3 in the following. In the drawings, a frame 3 supporting an outer shearing blade body 1 is removably fitted to shaver body 4, a hollow cylindrical driving shaft 8 is provided in the head part of a vibrating lever of an electromagnetic vibrator (not shown) provided within the shaver body 4 and a push-up coil spring 10 is provided within said driving shaft 8. An inner blade block 2 is formed in such that a plurality of knife-shaped blades are arranged on an inner blade base 12 and a pivot pin 7 is inserted through both legs of the inner blade base 12 which forming a U-shape. The pivot pin 7 is inserted through a guide bush 6 which is inserted between both legs of the inner blade base 12 so that the inner blade block 2 formed of said blades and inner blade base 12 will be rotated about said pivot pin 7 as an axis and operatively connected with the driving shaft 8 through said guide bush 6. Further, said guide bush 6 is connected at the other end with the driving shaft 8 so as to be slidable in the vertical directions and rotatable about the longitudinal axis *b* and vertical axis *a* of the inner blade block, so that said inner blade block 2 will be pressed against the outer shearing foil 1 by said push-up spring 10 and will rotate only about its crosswise axis *c*. However, in such structure, there are still involved such defects that, as the vibration of the driving shaft 8 provided in the upper part of a vibrating lever (not shown) is transmitted to the guide bush 6 at its lower end, its acting point will be caused to deviate from the engaging point of the inner blade block 2 and guide bush 6 by means of the pivot pin 7, the power transmitted by the vibrating lever will not be smoothly transmitted to the inner blade block 2, a waving motion in the lengthwise direction is apt to be given to the movement of the inner blade block as a result and the shaving effect will be remarkably deteriorated.

The present invention has been suggested to remove these defects in the conventional electric dry shavers. According to the present invention, in the electric dry shaver adapted to shave hairs by reciprocally driving the inner blade block while pressing the inner blade block in contact with the inside surface of the flexible outer shearing blade or foil, the inner blade block supported by a guide bush through a pivot pin is caused to be rotatable about the crosswise axis *c* of the same, that is, about the pivot pin as an axis, said guide bush is urged toward the side of the shearing foil and a driving shaft for driving the inner blade block is engaged to the guide bush adjacent the pivot pin, whereby the defects discussed in the foregoing have been successfully removed.

A principal object of the present invention is therefore to provide an electric dry shaver wherein an inner blade block is mounted to the shaver so as to be rotatable about the central axis intersecting horizontally crosswise its longitudinal axis so as to slide smoothly along inner surface of a flexible outer shearing foil while retaining intimate contact with it.

Another object of the present invention is to provide an electric dry shaver wherein the vibration of driving shaft is smoothly transmitted to the inner blade block without causing any waving motion of the inner blade block in its lengthwise direction.

A further object of the present invention is to provide an electric dry shaver wherein the inner blade block does not rotate about its vertical axis.

Another object of the present invention is to provide an electric shaver which can be easily cleaned by removing the inner blade block from the driving shaft.

Other objects and advantages of the present invention will be readily understood from the following explanations thereof detailed with reference to accompanying drawings, in which.

Figure 1:
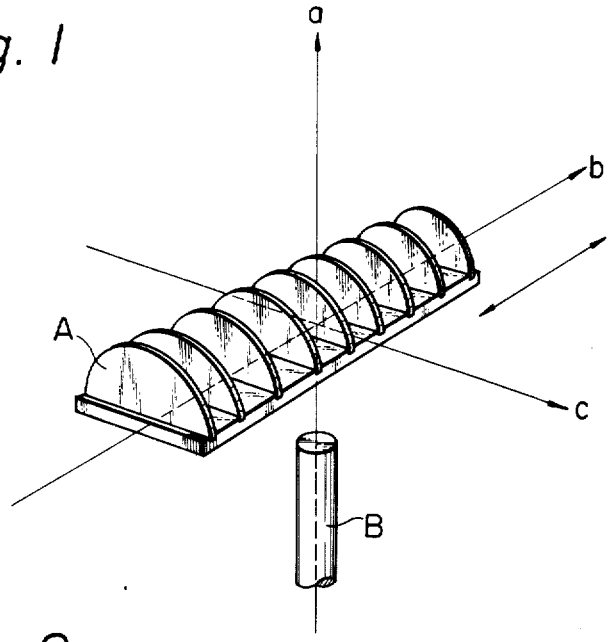
FIG. 1 is an explanatory view explaining the relation of an inner blade block and driving shaft.
Figure 2:
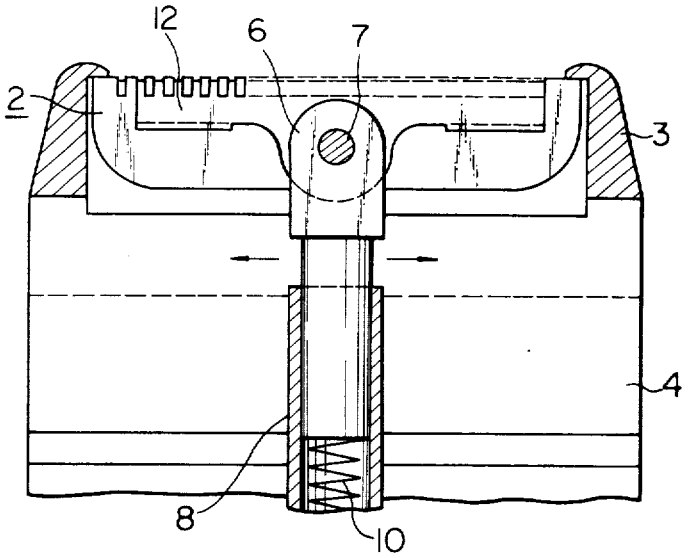
Fig. 2 PRIOR ART
FIGS. 2 and 3 show a conventional example, FIG. 2 being a sectioned view as seen from the front and FIG. 3 being a sectioned view as seen from the side of the example of FIG. 2.
Figure 3:
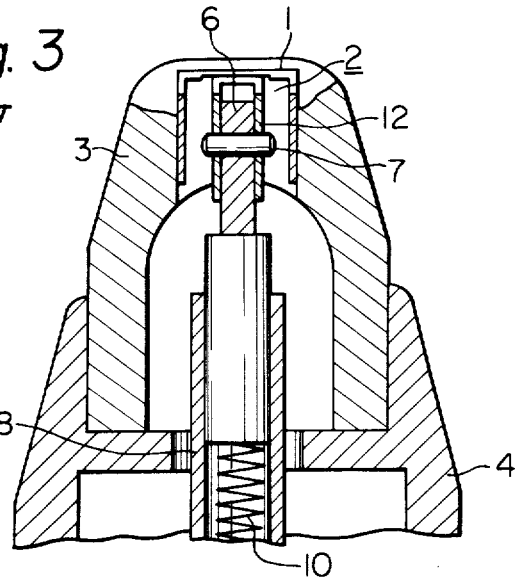
Fig. 3 PRIOR ART
Figure 4:
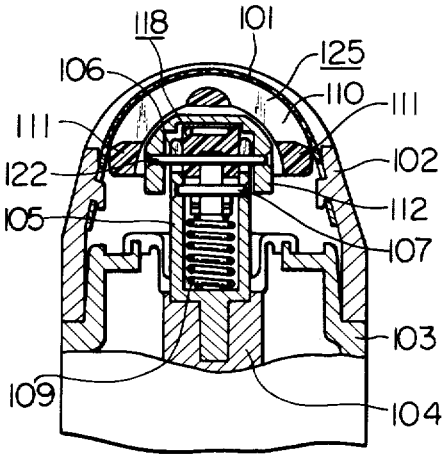
FIG. 4 shows an electric dry shaver embodying the present invention in a fragmentary sectioned view as seen from the side of head part.
Figure 5:
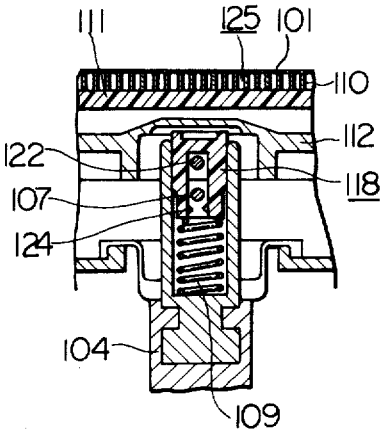
FIG. 5 is a fragmentary sectioned view showing connecting part of inner blade block and driving shaft in the shaver of FIG. 4 as seen from the front side.
Figure 6:
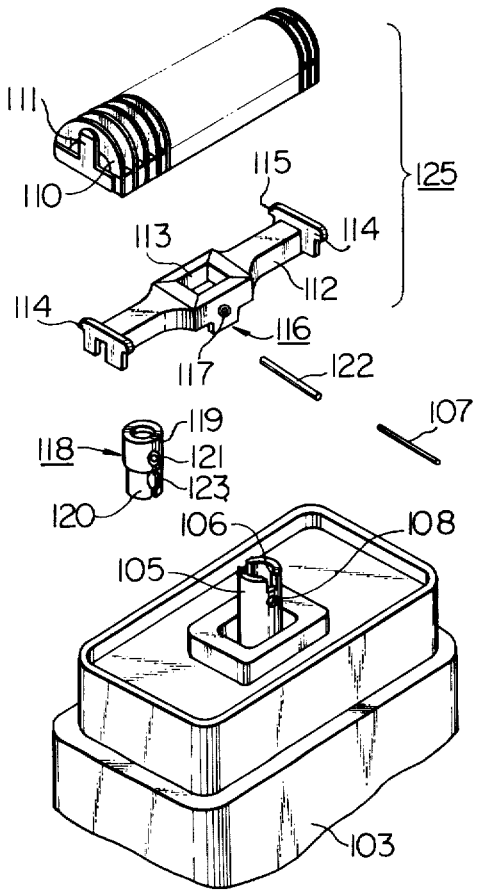
FIG. 6 is a perspective view of the inner blade block and driving shaft including their connecting means of FIG. 4 as disassembled.
Figure 7:
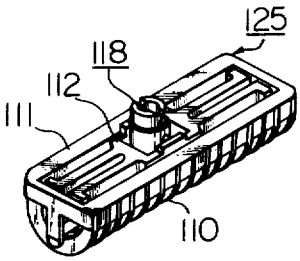
FIG. 7 is a perspective view of the inner blade block of FIG. 4 as assembled and seen from lower side thereof.
Figure 8:
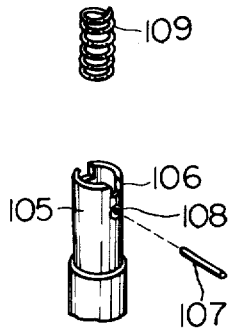
FIG. 8 is a perspective view of the driving shaft part of FIG. 4 as disassembled.
Figure 9:
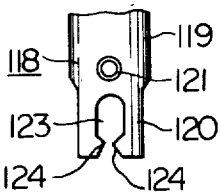
FIG. 9 is a fragmentary magnified side view of a guide bush in the arrangement of FIG. 4.

The present invention shall now be explained with reference to a preferred embodiment as shown in FIGS. 4 through 9. In the drawings, a reference 101 represents a flexible outer shearing foil having a plurality of holes or slits acting as hair inlet openings of any desired shape. Said shearing foil 101 is fitted to a frame 102 which is removably fitted to a shaver body 103 in any known manner. A vibrating lever 104 of a known electromagnetic vibrator (not shown) provided within the shaver body 103 is made of, for example, a synthetic resin containing reinforcing glass fibers. A hollow cylindrical driving shaft 105 made of a metal is connected to said vibrating lever 104 in its head part by being pressed in or simultaneously molded together so as to be projected in the upper part out of the upper surface of the shaver body 103. Further, two grooves 106 opening upward are provided symmetrically in the direction intersecting at right angles the reciprocal driving directions of this driving shaft at its upper end. The width of such grooves 106 may be preferably so formed that, when a later described pivot pin 122 is fitted through these grooves 106, the inner blade block will be movable only by such slight angle as 6 to 10 degrees with respect to the vertical axis *a*. Holes 108 to insert therethrough a spring holding pin 107 are further provided in positions similarly symmetrical with respect to the axis of the driving shaft and respectively below the grooves 106, and a coil-shaped push-up spring 109 inserted inside the cylindrical driving shaft 105 resiliently engages at the upperend with the spring holding pin 107 so as not to escape out of the driving shaft.

An inner blade block 125 shall be explained next in the following. A plurality of semicircular blades 110 are combined integrally with an inner blade base 111 made of a synthetic resin so that the respective blades will be in parallel relation to each other with any desired intervals. Further, in an inner blade supporting stand 116, a body 112 has an opening 113 substantially in the central part of the body and is provided at both ends with respective flanges 114 projecting upward and vertically with respect to the body 112 and at both ends of each flange 114 with engaging projections 115. The flanges 114 of the inner blade supporting stand 116 are, in assembling, pressed respectively into grooves (not shown) provided on the lower surface of the inner blade base 111 to couple the inner blade base 111 and inner blade supporting stand 116 integrally with each other so as to form the inner blade block 125. There are provided holes 117 in side walls of the central part of said inner blade supporting stand 116. A tubular guide bush 118 made of a highly wear proof synthetic resin is rotatably inserted as described later in the opening 113 in the central part of the inner blade supporting stand 116.

This guide bush 118 is formed in a stepped tubular shape having a head part 119 of a larger outer diameter and a lower part 120 of a smaller outer diameter. The outer diameter of the head part 119 is determined to be insertable into the hollow space in the cylindrical driving shaft 105 with such minimum clearance as, for example, about 3 to 35 microns. Further, the head part 119 is provided with a holes 121 of an inner diameter slightly larger than the diameter of a pivot pin 122 in symmetrical positions with respect to the axis of the tube. The lower part 120 is provided with slits 123 opened at the bottom end for engaging therein the spring holding pin 107. Inside said slits 123, there are provided projections 124 so that these projections 124 will provide a holding force of about 0.5 to 1.5 kg. for the pin 107 at the time of removing the same out of the slits.

Now, in order to assemble the guide bush 118 and driving shaft 105 with the inner blade 125, the head part 119 of said guide bush 118 is inserted into the opening 113 in the inner blade supporting stand 116, the pivot pin 122 is passed through the holes 117 in the side parts of the inner blade supporting stand 116 and the holes 121 in the guide bush 118 so as to rotatably connect the inner blade supporting stand 116 and the guide bush 118 with each other, the lower part 120 of the guide bush 118 is then inserted into the hole 105 in the driving shaft 105 and the lower slits 123 of the guide bush 118 are pressed into the spring holding pin 107 inserted in the holes 108 in the driving shaft 105. At this time, the head part 119 of the guide bush 118 will be also fitted into the hollow space in the driving shaft 105 so that the outer periphery of the head part 119 of the guide bush 118 in the driving shaft 105 will slidably contact with the inner surface of the driving shaft 105 and the pivot pin 122 will rest in the respective grooves 106 in the driving shaft 105 at adjacent parts of the pin. In this case, further, the lower end of the bush 118 passed over the pin 107 engages and compresses the push-up spring 109 and the guide bush 118 will be caused to be always urged upward by the push-up spring 109 so as to urge the inner blades 110 resiliently against the inside surface of the outer shearing foil 101.

The operation of the electric dry shaver of the present invention is such that, briefly, upon vibration of the vibrating lever 104, the driving shaft 105 will be vibrated and this vibration will be transmitted to the inner blade block 125 through the guide bush 118, so that the inner blade block 125 will reciprocate while being resiliently pressed against the shearing foil 101 by the force of the push-up spring 109.

With arrangement described in the foregoing, the present invention has the following features:

I. As the inner blade block is provided rotatable about the pivot pin 122 as the center with its longitudinal axis, the inner blade block can well follow any slight partial deformation of the flexible shearing foil or, in other words, will be able to keep its intimate contact with the foil's inner surface during the reciprocal vibration pursuing flexible deformation of the foil in use.

II. As the inner periphery of the driving shaft which driving the inner blade block and the outer periphery of the guide bush of the inner blade block are engaged in contact with each other near the pivot pin, that is, as the inner blade block and driving shaft are connected with each other near the center of gravity of the inner blade block, the inner blade block will cause no waving motion in its lengthwise direction along the reciprocal driving direction therefor, and the vibration of the driving shaft will be smoothly transmitted to the inner blade block to provide a favorable shaving effect.

III. As the pivot pin of the inner blade block is inserted in the grooves of the driving shaft which are extending in crosswise directions intersecting at right angles the longitudinal axis of the block, this inner blade block will be substantially prevented from rotating about its vertical axis passing the center and, therefore, the intimate surface contact of the inner blade block with the outer shearing foil will be free from being obstructed by any sideward pressure apt to be applied by both side skirts of the shearing foil when such rotation occurs, so that the shearing foil and inner blade block will remain in favorable contact with each other for smooth shaving.

IV. As the inner blade block is formed to be detachable from the driving shaft, easinesses in the maintenance, repair and cleaning of the inner blade block can be well achieved and, further, the inner blade blocks can be individually manufactured so as to simplify their manufacturing steps.

V. As the push-up spring is arranged within the hollow cylindrical driving shaft while the spring holding pin is fitted to the upper part of the driving shaft to lie in the shaft's diametral direction and the guide bush having the downward opened slits opposing also in the diametral direction for receiving the spring holding pin is brought into resilient contact with said push-up spring so as to compress the same at the lower end which passed over the holding pin, the inner blade block will be pushed up by the push-up spring so as to achieve the favorable contact with the inside surface of the outer shearing foil and, at the same time, the push-up spring is prevented from escaping out of the driving shaft by means of the spring holding pin even when the inner blade block is disassembled from the driving shaft.

VI. As the projections are provided in the lower parts of the slits in the guide bush so as to provide a removable holding force for the spring holding pin, the driving shaft and inner blade block can be positively connected with each other by such holding force that requiring a snapping operation at the time of the connecting work of them, so that the inner blade block can be prevented from being accidentally detached from the driving shaft, whereby any parts of the block, specifically inner blade edges, can be prevented from being accidentally damaged.

While the present invention has been described in the foregoing with reference to the preferred embodiment shown, it will be obvious to those skilled in the art that the invention shall not be limited to the particular embodiment but rather various changes, modifications and equivalent arrangements may be made therein without departing from the invention, and it is aimed, therefore, to cover in the appended claims all such changes, modifications and equivalent arrangements as fall within the scope of the invention.

What is claimed is:

1. An electric dry shaver comprising a shaver body, an outer blade block mounted to the upper end of said shaver body and including an outer shearing blade of flexible metal foil mounted substantially in semi-cylindrical shape and defining a plurality of hair inlet openings, an inner blade block including a plurality of inner shearing blades respectively having substantially semicircular shearing edges conforming to inner surface of said outer shearing blade and arranged along the longitudinal axial line of said outer blade in parallel relation to each other, vibrating means including a drive shaft housed in said shaver body for reciprocatingly driving said inner blade block along said axial line, a motor coupled to the drive shaft, said inner blade block having a drive coupling including a connecting means which is disposed substantially at the center of gravity of the block and which is rockable about a transverse axis which passes substantially through said center of gravity and intersects at right angles the axial line of the outer blade, said driving shaft being slidably connected to the coupling adjacent the rocking axis of said connecting means with the inner blade block, said coupling being in the form of a cylindrical member aligned with said drive shaft and said connecting means being in the form of a pivot shaft lying at said rocking axis, said drive shaft having a cylindrical recess at its upper end for receiving said cylindrical member, and a resilient coil spring seated in the recess of the drive shaft so that said cylindrical member engages compressively with said resilient spring, said drive shaft being provided with a retainer pin secured across the cylindrical recess so as to keep said coil spring captive in the recess, and said cylindrical member being formed at its inner end with a vertical slot so that, when the cylindrical member is engaged in the recess, said retainer pin will engage in said slot with the end of the cylindrical member extending inwardly beyond the pin to compressively engage the coil spring.

2. The dry shaver according to claim 1 wherein each side of the slot is provided with a projection adjacent its open end to define a gap slightly smaller than outer diameter of said retainer pin.

3. An electric dry shaver comprising, in combination, a shaver body, an outer shearing blade of semi-cylindrical shape mounted at the upper end of the body and defining a longitudinal axis having a vertical axis perpendicular thereto, an inner blade assembly including (a) a rectangular frame having a plurality of semi-annular blades spaced parallel to one another and (b) a yoke nested longitudinally in the frame and forming an integral unit therewith, the yoke having a central opening accessible from the underside, a drive coupling extending upwardly into the region enclosed by the central opening, a pivot pin bridging the central opening in the yoke and pivotally engaging the drive coupling, a drive shaft extending vertically in the shaver body, means including a motor for swinging the shaft back and forth in the direction of the longitudinal axis, the shaft having a telescoping connection with the drive coupling providing limited freedom of the drive coupling with respect to the drive shaft along the vertical axis and limited rotational freedom of the drive coupling with respect to the drive shaft about the vertical axis, a push-up spring interposed between the shaft and the drove coupling so that the inner blade assembly is resiliently pressed upwardly into engagement with the outer shearing blade, the pivot pin being perpendicular to the longitudinal axis and vertical axis and located substantially at the center of gravity of the inner blade assembly so that purely translational force is applied by the drive coupling to the blade assembly.

4. An electric dry shaver comprising, in combination, a shaver body, an outer shearing blade of semi-cylindrical shape mounted at the upper end of the body and defining a longitudinal axis, an inner blade assembly including (a) a rectangular frame having a plurality of semi-annular blades spaced parallel to one another and (b) a yoke nested longitudinally in the frame and engaging the frame at the ends thereof, the yoke having a central opening accessible from the underside, a drive coupling extending upwardly into the region enclosed by the central opening, a pivot pin bridging the central opening in the yoke and pivotally engaging the drive coupling, a drive shaft extending vertically in the shaver body, means including a motor for swinging the shaft back and forth in the direction of the longitudinal axis, the shaft having a telescoping connection with the drive coupling, a push-up spring interposed between the shaft and the drive coupling so that the inner blade assembly is resiliently pressed upwardly into engagement with the outer shearing blade, the pivot pin being perpendicular to the longitudinal axis and located substantially at the center of gravity of the inner blade assembly so that purely translational force is applied by the drive coupling to the blade assembly.

5. An electic dry shaver comprising, in combination, a shaver body, an outer shearing blade of semi-cylindrical shape mounted at the upper end of the body and defining a longitudinal axis having a vertical axis perpendicular thereto, an inner blade assembly including (a) a rectangular frame having a plurality of semi-annular blades spaced parallel to one another and (b) a yoke nested in the frame of secured therein to form an integral unit therewith, the yoke having a central opening accessible from the underside, a drive coupling in the form of a cylindrical bushing extending upwardly into the region enclosed by the central opening, a pivot pin bridging the central opening in the yoke and pivotally engaging the upper end of the bushing, a drive shaft extending vertically in the shaver body, means including a motor for swinging the shaft back and forth in the direction of the longitudinal axis, the upper end of the shaft being hollow for telescoping reception of the cylindrical bushing, the bushing having limited translational and rotational freedom in the shaft, a coiled push-up spring seated in the hollow of the shaft and engaging the underside of the bushing so that the inner blade assembly is resiliently pressed upwardly into engagement with the outer shearing blade, the pivot pin being perpendicular to the longitudinal axis and vertical axis and located substantially at the center of gravity of the inner blade assembly so that purely translational force is applied by the drive coupling to the blade assembly.

6. The combination as claimed in claim 5 in which the shaft has a retainer pin diametrically extending across the hollow above the compressed level of the spring and in which the bushing has a vertical slot at its lower end to provide clearance for the pin, the bushing being formed of resilient material and the lower extremity of the slot having a slight interference fit with respect to the retainer pin so that the retainer pin holds the bushing detentingly captive in the shaft while permitting the bushing and the inner blade assembly which is pinned thereto to be drawn free of the shaft as a unit by overcoming the detent force.

7. The combination as claimed in claim 5 in which the upper end of the drive shaft is formed with a pair of diametrically aligned notches substantially wider than the diameter of the pivot pin to receive and provide clearance for passage of the pivot pin.

* * * * *